US005105746A

United States Patent [19]

Reynolds

[11] Patent Number: 5,105,746

[45] Date of Patent: Apr. 21, 1992

[54] INTERLOCKING PALLET

[75] Inventor: William B. Reynolds, Fayetteville, N.C.

[73] Assignee: E. I. Du Pont de Nemours and Company, Wilmington, Del.

[21] Appl. No.: 707,772

[22] Filed: May 30, 1991

Related U.S. Application Data

[63] Continuation-in-part of Ser. No. 554,474, Jul. 9, 1990, abandoned.

[51] Int. Cl.[5] ..... B65D 19/12

[52] U.S. Cl. ..... 108/56.1; 108/51.1

[58] Field of Search ..... 108/51.1, 55.3, 56.1, 108/57.1, 54.1, 64, 65; 403/297; 248/346; 24/33 P

[56] References Cited

U.S. PATENT DOCUMENTS

| | | | |
|---|---|---|---|
| 1,975,862 | 10/1934 | Olson | 24/33 P |
| 3,059,887 | 10/1962 | Ward, Jr. | 108/51.1 |
| 3,429,536 | 2/1969 | Petry et al. | 108/55.3 X |
| 3,540,318 | 11/1970 | Greenberg | 24/33 P |
| 3,650,224 | 3/1972 | Petix et al. | 108/51.1 |
| 3,650,225 | 3/1972 | Ball | 108/51.1 |
| 4,095,769 | 6/1978 | Fengels | 108/64 X |
| 4,516,677 | 5/1985 | Rowcand et al. | 108/55.3 X |
| 4,580,680 | 4/1986 | Wind | 108/55.3 X |
| 4,694,962 | 9/1987 | Taub | 108/56.1 X |
| 4,735,154 | 4/1988 | Hemery | 108/56.1 |
| 4,869,179 | 9/1989 | Sammons | 108/56.1 |

FOREIGN PATENT DOCUMENTS

| | | | |
|---|---|---|---|
| 1241565 | 8/1960 | France | 108/51.1 |
| 1156430 | 6/1969 | United Kingdom | 108/51.1 |

*Primary Examiner*—José V. Chen
*Attorney, Agent, or Firm*—James T. Corle

[57] ABSTRACT

A pallet is formed from at least two sections which are releasably locked together through mating knuckles on adjoining sections to provide a rigid integrated platform.

8 Claims, 3 Drawing Sheets

INTERLOCKING PALLET

CROSS REFERENCE TO RELATED APPLICATION

This application is a continuation-in-part of Ser. No. 07/554,474 filed Jul. 9, 1990 now abandoned.

BACKGROUND OF THE INVENTION

This invention relates to a new interlocking pallet comprised of at least two sections which can be joined together.

Interlocking pallets which are formed by a plurality of sections are known. These pallets are useful for supporting loads to be moved by lift trucks, particularly when only a portion of a load is to be transported from place to place. Such a pallet is disclosed in U.S. Pat. No. 3,650,224. While the various sections of the pallet can be joined in a releasable interlocking relationship, no positive locking means is provided, and in lifting and moving the pallet, the sections may come apart.

SUMMARY OF THE INVENTION

In accordance with the present invention there is provided a pallet consisting of at least two sections having releasable interlocking means for positively joining the sections together. The locking means effectively prevents separation of the sections during both lateral and vertical movement of the pallet.

Each section of the pallet has a top load supporting deck with foot members positioned at each corner of the section. The locking means comprises knuckles on each section which can be brought into mating relationship. The knuckles of a first section are spaced apart along the periphery of at least one side of the deck and along an underlying member on an adjoining side of the deck. When similarly configured sections are in the mated position, the two sections can be locked together to provide a rigid integrated platform by inserting a locking member through openings in the mated knuckles.

In another embodiment of the pallet of this invention, knuckles on a first section of the pallet are spaced apart along the periphery of the surface of at least one side of the deck and along a member underlying the side of the deck. Knuckles on a second section of the pallet are similarly spaced apart as just described to permit mating with knuckles on the first section of the pallet. When the knuckles of the two sections are in the mated position, the sections can be locked together by inserting a locking member through openings in the mated knuckles.

DETAILED DESCRIPTION OF THE PREFERRED EMBODIMENT

Figure 1:
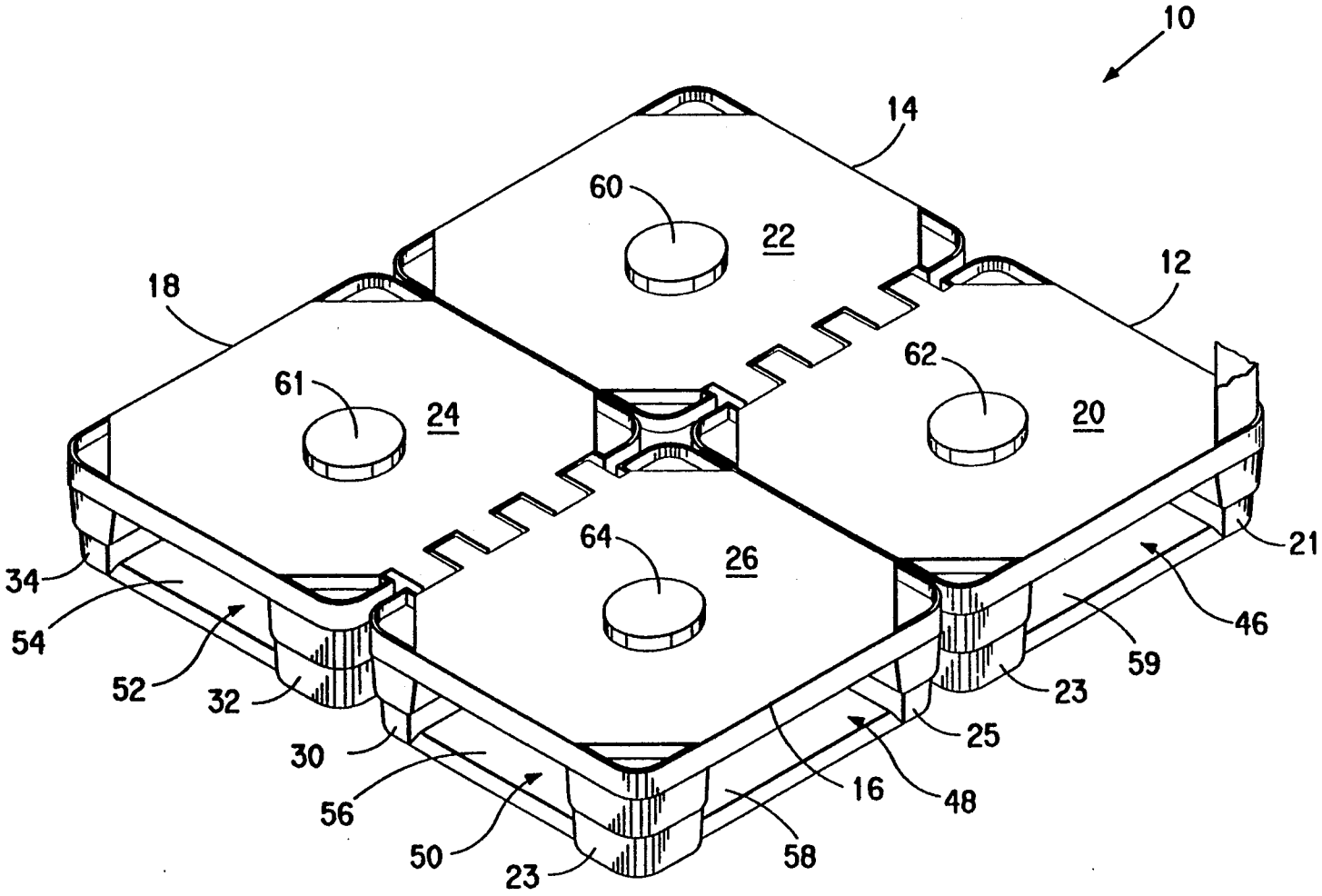
FIG. 1 is a perspective view of a pallet of the present invention illustrated by four interlocked sections.

Referring to FIG. 1, pallet 10 is comprised of four sections 12, 14, 16 and 18. Each of the four sections is substantially identical having a top load supporting deck 20, 22, 24 and 26 and foot members 21, 23, 25, 28, 30, 32 and 34 at the corners of each section.

Figure 2:
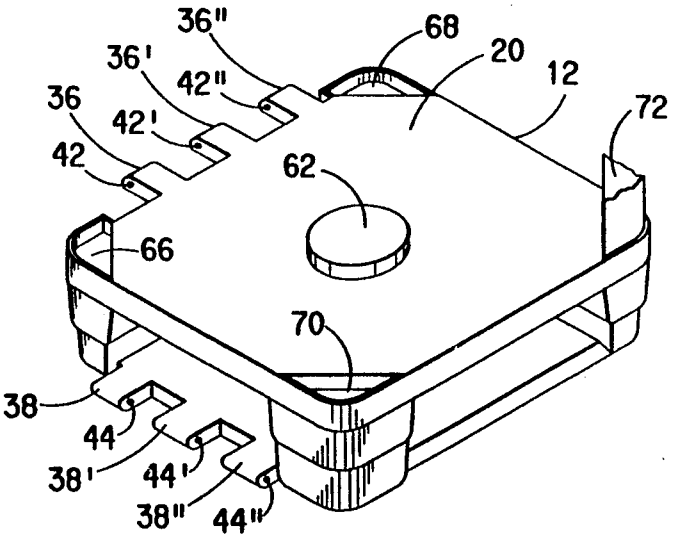
FIG. 2 is a view of one section of the pallet of FIG. 1.

Section 12 is shown in more detail in FIG. 2. Knuckles 36, 36' and 36" are spaced apart along the periphery of the surface of deck 20. Similar knuckles 38, 38' and 38" are spaced apart along stringer 40. The knuckles have eyes 42, 42', 42", 44, 44' and 44" for receiving locking members. Sections 14, 16 and 18 include similarly spaced knuckles and eyes.

As shown in FIG. 1, the sections have openings 46, 48, 50 and 52 which are wide enough to permit entry of the forks of a fork-lift or pallet truck. Stingers 54, 56, 58 and 59 have beveled outer and interior surfaces, preferably beveled at a 45 degree angle, to permit easy access and withdrawal of the wheels of a pallet truck.

The embodiments shown in the Figures are configured to transport large rolls of film. As shown in FIG. 1, nodes 60, 61, 62 and 64 protrude from the surface of the sections. An open end of the core of a roll in an upright position is placed over the node to assist in retaining the roll on the pallet. The node as well as the surface of the section should be suitably reinforced for supporting heavy loads. Other configurations could be used to accommodate differently shaped loads.

As best shown in FIG. 2, the surface 20 of section 12 includes wells 66, 68 and 70 for receiving corner posts. A triangular shaped post 72, a portion of which is shown, or other configuration may be used. The posts can support a cover plate, not shown, which would include nodes for receiving the open end of the core of a roll standing on the pallet. A cover plate is necessary to protect the rolls on the pallet during shipping and stacking. A stretch-wrap package can be provided for encasing the pallet, rolls and the cover plate using a suitable polymeric film.

Figure 3:
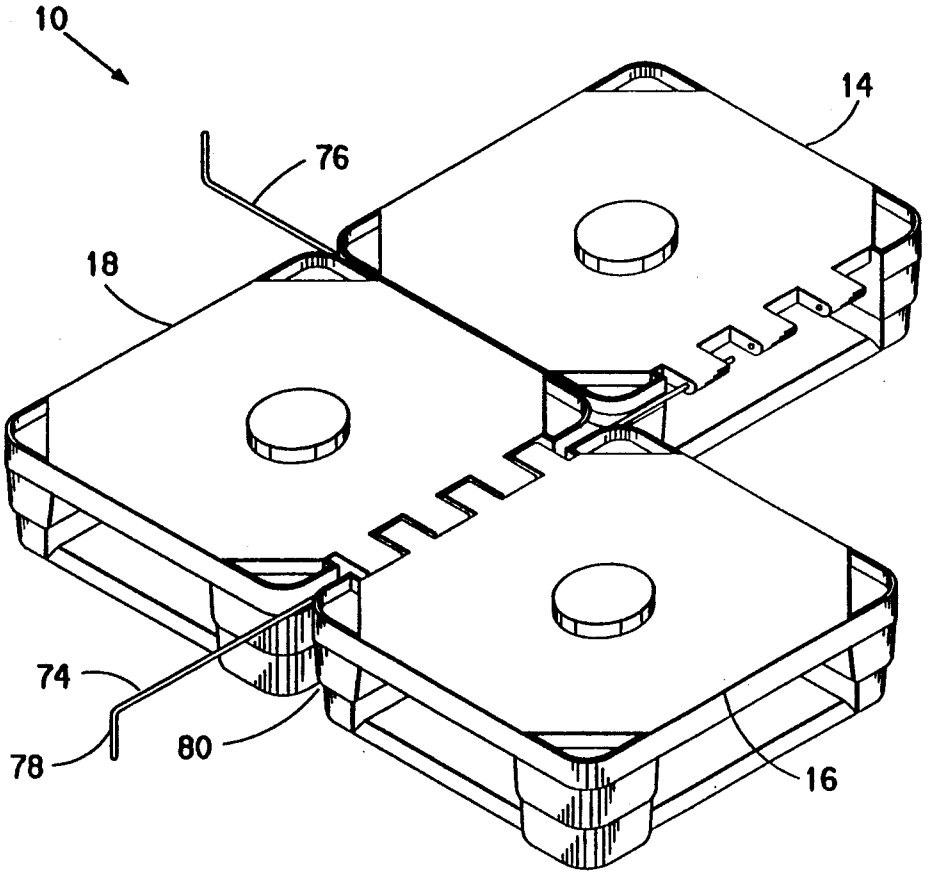
FIG. 3 is view of the pallet shown in FIG. 1 in a partially broken down state.

Referring now to FIG. 3, pallet 12 is shown in a partially broken down state. Locking rod 74 is shown partially inserted through the knuckles of adjoining sections 16 and 18. A second locking rod 76 is also shown partially inserted through knuckles on sections 14 and 18. When rod 74 is fully inserted, bent end 78 fits into groove 80 which is formed between sections 16 and 18. A similar groove accommodates the end of rod 76.

Figure 4:
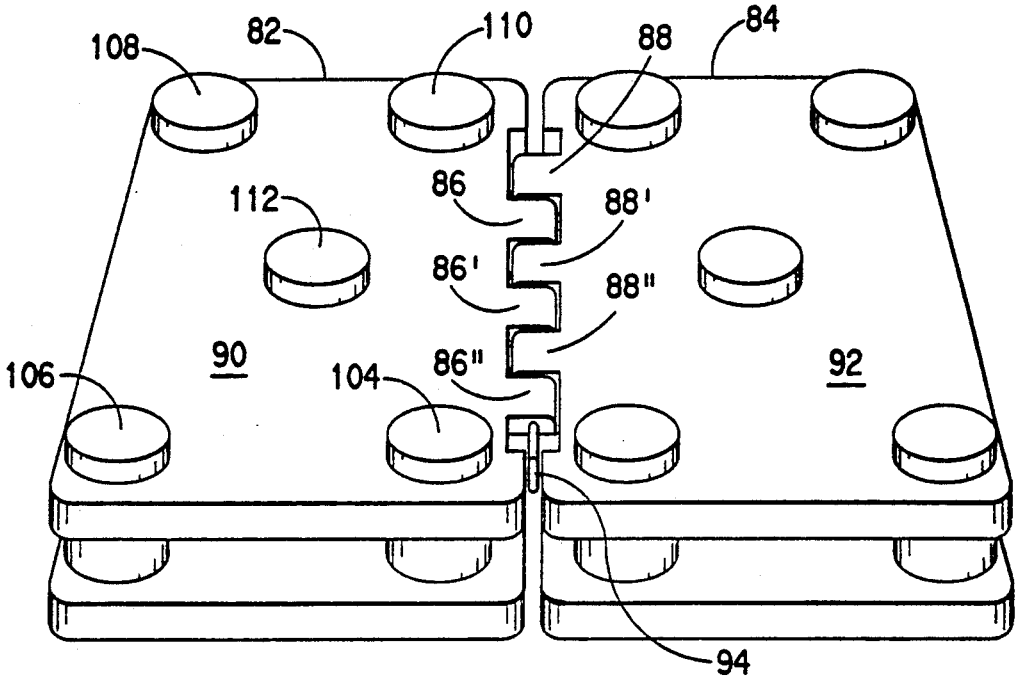
FIG. 4 is a view of another embodiment of the present invention illustrated by two interlocked sections.

In another embodiment of the pallet of this invention shown in FIG. 4, sections 82 and 84 have knuckles 86, 86', 86", 88, 88' and 88" spaced along the periphery of decks 90 and 92. Rod 94 is shown in the locking position securing the sections together.

Figure 5:
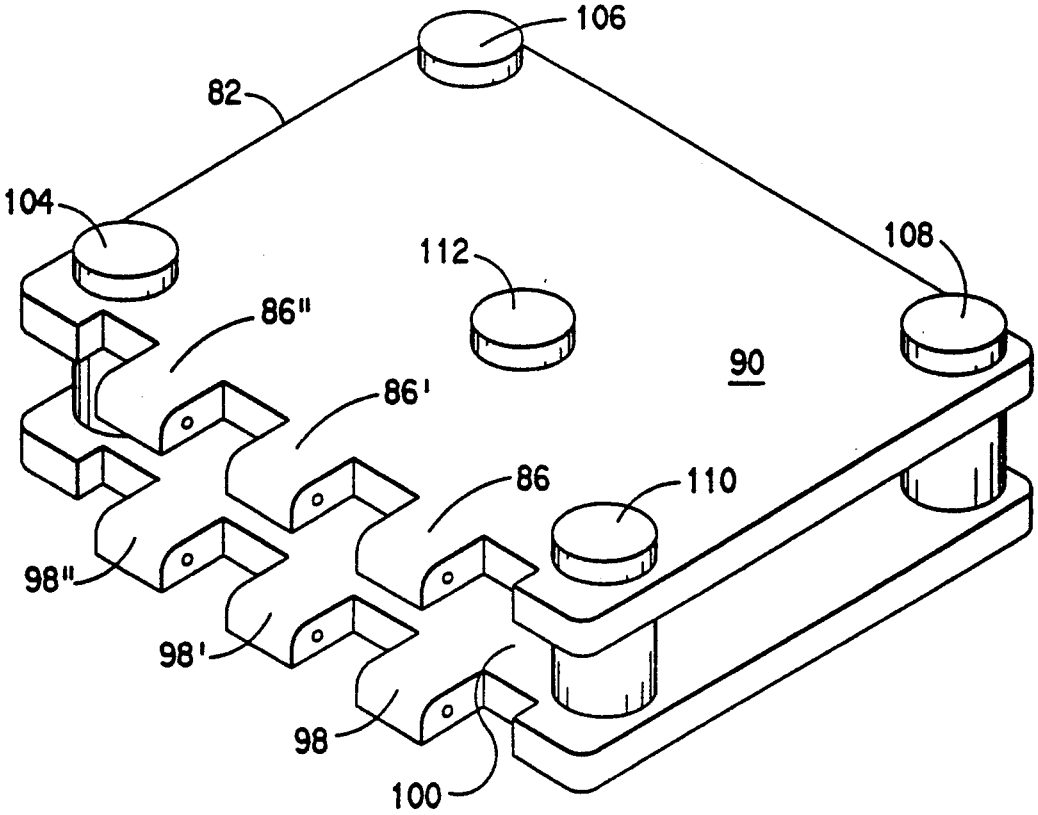
FIG. 5 is a view of one section of the pallet of FIG. 4.

Section 82 is shown in more detail in FIG. 5. A second set of knuckles 98, 98' and 98" is shown on underlying stringer 100. When two sections are mated, locking rods can be inserted in both the upper and lower sets of knuckles. The surface of the deck 102 of section 82 is configured with nodes 104, 106, 108, 110 and 112 to receive the hollow end of cores of rolls of film.

The pallets of this invention may be constructed from a variety of materials. They may be molded from polymeric materials such as ABS resins, high density polyethylene and polyesters. Recylcable material are particularly suited for this purpose. In molding the pallets the deck portions and the lower portion which includes the stringers and foot members can each be molded separately and joined together by suitable fastening means. Preferably, the foot members and stringers are molded simultaneously as contiguous members. However, the sections of the pallet may be molded as integral units. Various known molding techniques can be used.

While particular embodiments of this invention have been shown and described, it will be apparent to those skilled in the art that various changes and modifications may be made therein without departing from the scope of the invention.

I claim:

1. A pallet comprised of at least two sections having releasable interlocking means for joining said sections together, each section having a top load supporting deck with an underlying supporting member, a plurality of knuckles integral with and spaced along the periphery of at least one side of said top load supporting deck and a plurality of knuckles integral with and spaced along the underlying supporting member on an adjoining side of said deck, the knuckles on a first section of said pallet being spaced apart to permit mating with corresponding knuckles on a second section of said pallet, said knuckles being adapted to receive a releasable locking member when brought into mating relationship, said sections being joined together to provide a rigid integrated platform when said locking member is inserted through the knuckles on said first and second sections of said pallet.

2. The pallet of claim 1 wherein each section of said pallet has a node centrally located and projecting from the surface of said deck for receiving a hollow core of a roll when said roll is placed in a standing position on said deck.

3. The pallet of claim 1 wherein each section has foot members contiguous with said underlying members, said foot members being positioned at each corner of said section.

4. The pallet of claim 1 wherein said knuckles have eyes adapted to receive an elongated rod for securing said sections in interlocking relationship.

5. A pallet comprised of at least two sections having releasable interlocking means for joining said sections together, each section having a top load supporting deck with foot members positioned at each corner of said section, each section having a first set of knuckles integral with and spaced along the periphery of the surface of at least one side of said top load supporting deck and a second set of knuckles integral with and spaced along a member underlying said first set of knuckles, said first and second sets of knuckles being spaced apart to permit mating with knuckles on a second section of said pallet, said knuckles being adapted to receive a releasable locking member when brought into mating relationship, said sections being joined together to provide a rigid integrated platform when said locking member is inserted through said knuckles on said first and second sections of said pallet.

6. The pallet of claim 5 wherein each section of said pallet has at least one node projecting from the surface of said deck for receiving a hollow core of a roll when said roll is placed in an upright position on said deck.

7. The pallet of claim 5 wherein said foot members are contiguous with members underlying said supporting deck.

8. The pallet of claim 5 wherein said knuckles have eyes adapted to receive an elongated rod for securing said sections in interlocking relationship.

* * * * *